US006877286B2

(12) United States Patent
Johnson

(10) Patent No.: US 6,877,286 B2
(45) Date of Patent: Apr. 12, 2005

(54) INSULATIVE WINDOW COVERING

(75) Inventor: Terry L. Johnson, Ogden, UT (US)

(73) Assignee: Clearview Windows Mfg. L.L.C., Bluffdale, UT (US)

( * ) Notice: Subject to any disclaimer, the term of this patent is extended or adjusted under 35 U.S.C. 154(b) by 0 days.

(21) Appl. No.: 10/429,075

(22) Filed: May 2, 2003

(65) Prior Publication Data

US 2004/0216401 A1 Nov. 4, 2004

(51) Int. Cl.[7] ..... E04C 2/54

(52) U.S. Cl. ..... 52/202; 52/208; 52/786.11; 52/786.1; 52/788.1; 52/789.1; 52/790.1; 52/630; 52/204.593

(58) Field of Search ..... 428/34, 38; 52/202, 52/204.593, 208, 786.11, 783.1, 786.1, 788.1, 789.1, 790.1, 792.1, 796.1, 630, 309.5, 309.8, 311.1, 311.2

(56) References Cited

U.S. PATENT DOCUMENTS

| | | | | |
|---|---|---|---|---|
| 2,935,769 | A | 5/1960 | Lutes | |
| 4,198,796 | A | 4/1980 | Foster | 52/203 |
| 4,204,015 | A | 5/1980 | Wardlaw et al. | |
| 4,255,908 | A | 3/1981 | Rosenberg | 52/2.12 |
| 4,450,660 | A | 5/1984 | Dean et al. | |
| 4,544,587 | A | 10/1985 | Nesbitt | |
| 4,649,681 | A | 3/1987 | Eisele | |
| 4,699,842 | A | 10/1987 | Jorgensen et al. | |
| 5,644,874 | A | 7/1997 | McKann | |
| 5,794,404 | A | 8/1998 | Kim | 52/786.13 |
| 5,937,595 | A | 8/1999 | Miller | |
| 6,052,957 | A | 4/2000 | Minnich | |
| 6,138,433 | A | 10/2000 | Ridge | 52/786.11 |
| 6,141,921 | A | 11/2000 | Leeuwenburgh et al. | |
| 6,250,027 | B1 | 6/2001 | Richards | 52/204.59 |

*Primary Examiner*—Naoko Slack
*Assistant Examiner*—Jennifer I. Thissell
(74) *Attorney, Agent, or Firm*—Thorpe North & Western, LLP

(57) ABSTRACT

A thermal window insert includes at least two substantially parallel, substantially transparent sheets of flexible polymer material having a gap therebetween. The two sheets are bonded together at deformations formed in at least one of the sheets, and have a size approximately corresponding to the dimensions of a window opening in a building. A strip of resilient material is directly bonded to the sheets around the perimeter thereof, so as to seal the gap between the transparent sheets and to provide a seal between the window insert and the window opening. The invention is similar to storm windows, but is of a simpler and less expensive construction, and is easy to install, remove and store.

18 Claims, 5 Drawing Sheets

DETAIL C

SECTION A-A

SECTION B-B

INSULATIVE WINDOW COVERING

BACKGROUND OF THE INVENTION

1. Field of the Invention

The present invention relates to an insulating window covering formed of transparent flexible material and, more particularly, to such an insulating window covering which utilizes air as the insulating medium.

2. Related Art

In temperate or cold climates, it is desirable to minimize heat losses through windows, especially during the coldest months of the year. It is, of course, well known that so-called storm windows can be used for this purpose, as well as special multi-pane windows. Storm windows and multi-pane windows are generally designed to provide one or more insulating pockets of air that help reduce heat loss through a window. Both solutions, however, are relatively expensive.

Moreover, storm windows present the additional disadvantage that they are typically heavy and cumbersome to remove and store. Because they are normally installed on the outside of a building, storm windows must use relatively heavy, rigid materials such as glass or plexiglass. Their installation can be somewhat hazardous, generally requiring the use of a ladder, and presenting danger of injury to the installer and the possibility of damage to the storm windows. Additionally, the storm windows must be stored with great care to prevent damage.

To address some of the shortcomings of storm windows, multi-pane windows, and the like, a variety of temporary, interior-use insulating covers for windows have been devised. Some interior-use insulating window covers still employ heavy glass or plexiglass, and thus do not eliminate most of the problems of conventional storm windows. However, because wind and precipitation are not a concern inside a building, other temporary insulating windows employ more lightweight, flexible transparent materials. Of these, most comprise a continuous frame that fits within or around a window opening, with one or more sheets of transparent or semi-transparent material extending across the frame. In some of these prior devices, the perimeter frame is designed to frictionally fit into the window opening. Other prior designs include an inflatable portion that can be inflated to snugly hold the insulating window cover frame in the window opening, or involve mechanical fasteners.

In some prior designs, two or more transparent sheets are provided, and the space between the sheets is filled with a gas. The space between the sheets may also be subdivided into separate compartments, and these compartments may be sealed from each other or in fluid communication with each other.

As is apparent from the above description, prior temporary insulating window coverings tend to be complex in design, manufacture or usage. Some of them solve some of the problems associated with heavy storm windows, but do so in a manner that raises other problems. For example, some of them have a poor appearance. Where an insulating window cover includes a perimeter frame, in many cases the frame must be custom made to fit an interior window opening that is not of a standard size. This makes such windows very expensive. Even with standard sizes, there are such a wide variety of standard window shapes and sizes that a producer of such devices would need a very large inventory to meet the wide variety of needs.

SUMMARY OF THE INVENTION

It has been recognized that it would be desirable to have a temporary insulating window that is lightweight and easy to install.

It would also be desirable to have a temporary insulating window covering that is simple to manufacture and custom-fit to any window shape or size.

It would also be desirable to have a temporary insulating window covering that provides a pleasing appearance.

The present invention advantageously provides a temporary insulating window covering which is of a particularly simple, inexpensive, and lightweight construction, and which is constructed in a manner such that the overall size and shape of the window covering may be readily varied during manufacture.

In accordance with one embodiment thereof, the present invention provides an insulative window covering, configured to be frictionally inserted into a window opening in a building. The window covering comprises first and second parallel sheets of substantially transparent material. These sheets have inner and outer surfaces, and at least one of the sheets includes at least one inwardly extending, flat-topped deformation, the two sheets being bonded together at the flat-topped deformation. A strip of resilient, compressible material is bonded around the aligned periphery of the first sheet and the second sheet, and provides a substantially airtight enclosure envelope between the two sheets, and a substantially airtight seal between the window opening and the window covering. An inert gas may be disposed in the enclosure envelope between the first and second sheets.

In accordance with a more detailed aspect thereof, the flat-topped deformations may comprise a plurality elongate ridges, configured to divide the enclosure envelope into a plurality of discrete volumetric regions, and to create the appearance of separate window panes.

In accordance with another detailed aspect thereof, the elongate ridges may include gaps, so as to allow fluid communication between the discrete volumetric regions.

Additional features and advantages of the invention will be apparent from the detailed description which follows, taken in conjunction with the accompanying drawings, which together illustrate, by way of example, features of the invention.

DETAILED DESCRIPTION

Figure 1:
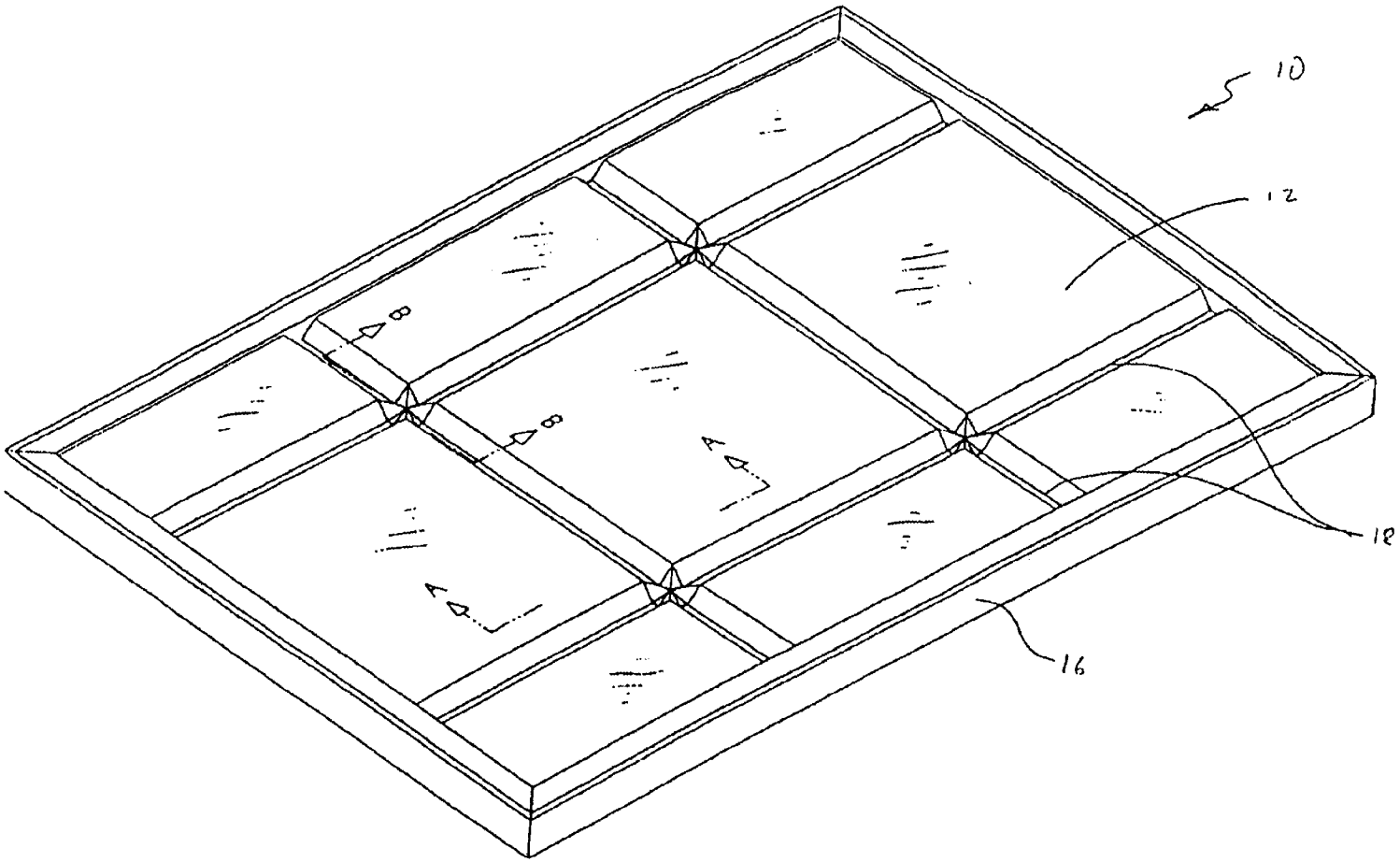
FIG. 1 is a perspective view of one embodiment of an insulative window covering in accordance with the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

The present invention is used somewhat in the same manner as a storm window, but is of a simple and inexpensive construction, and is easy to install, remove and store. Referring to FIGS. 1–6, the invention is a temporary insulating window covering 10 generally comprising a first sheet 12 and second parallel sheet 14 of transparent flexible material, such as PET, PVC, PETG, or other suitable strong, impact resistant transparent materials. The two sheets are of substantially the same size and shape, with their perimeter edges aligned. An edge strip 16 of resilient compressible material is adhesively bonded around the periphery of the insulative window covering to provide a substantially airtight enclosure envelope surrounding the space 22 between the two sheets.

Figure 7:
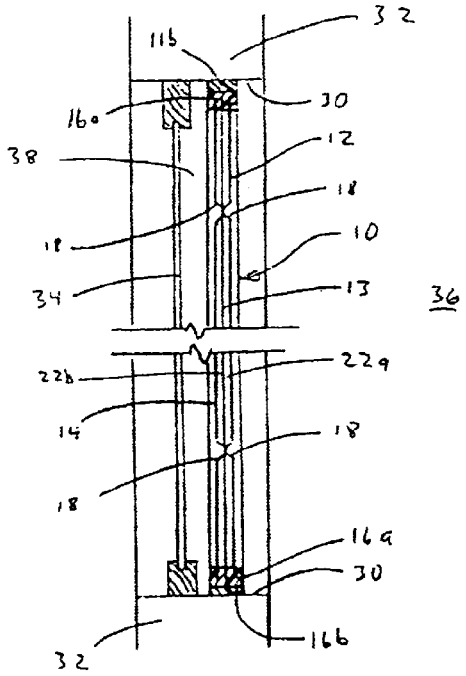
FIG. 7 is a cross-sectional view of the window covering inserted into a window opening, and showing one embodiment of the formable perimeter gasket.
Figure 8:
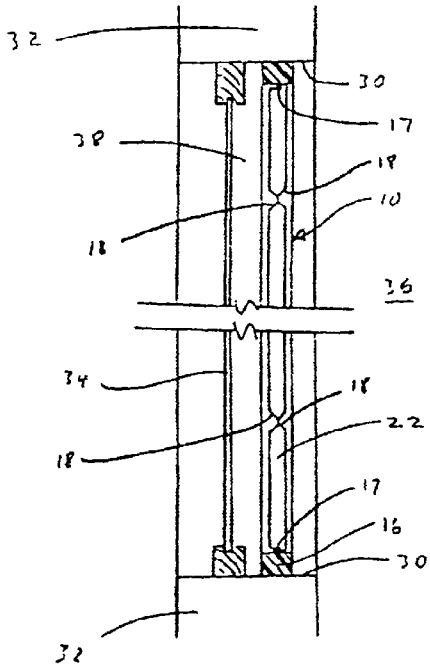
FIG. 8 is a cross-sectional view of the window covering inserted into a window opening, and showing an alternative embodiment of the formable perimeter gasket.
Figure 9:
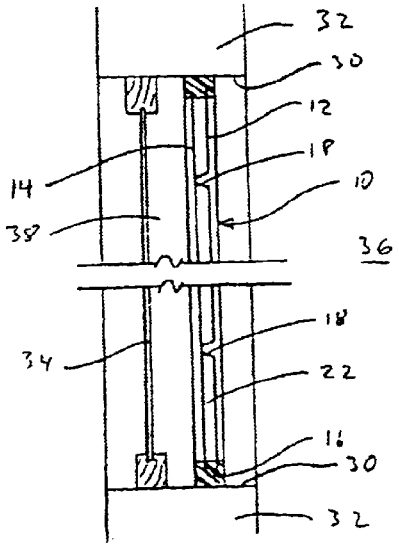
FIG. 9 is a cross-sectional view of the window covering inserted into a window opening, and showing yet another alternative embodiment of the formable perimeter gasket.

The edge strip also allows the window cover to be tightly frictionally pressed into a window opening 30 in a building wall 32, and provide a substantially airtight seal (See FIGS. 7–9). The space 22 between the two sheets is filled with a gas, preferably an inert gas such as nitrogen, helium, neon, argon, krypton, or xenon. However, other gasses may also be used, including air from the atmosphere, so long as there is substantially no water or other vapor in the gas that could condense on the inside of the sheets. This configuration thus provides at least two insulating gas layers between the window 34 and the interior 36 of the building. The first insulating layer is the layer 38 of atmospheric air between the window and the window covering. The second is the gas space 22 between the transparent sheets.

Advantageously, the insulative window covering 10 does not require a perimeter frame. Instead, the transparent sheets 12, 14, bonded together in various places and/or along their periphery, provide sufficient strength when combined with the compressible edge strip, such that a perimeter frame is not required. Referring to FIGS. 7 and 9, in one embodiment, the first and second sheets are directly embedded into the edge strip. Referring to FIG. 8, in another embodiment, the perimeter of the first sheet is bonded to the perimeter of the second sheet along a folded-down tab 17, and the edge strip is bonded to the outside of this folded-down tab.

The edge strip 16 can be any of a variety of resilient, compressible materials, preferably lightweight polymer foam materials, such as neoprene, Eva, polyurethane, polyolefin, and elastomeric gel. One particular material that appears to be suited to this use is closed cell cross-linked polyolefin The edge strip material is preferably formed or treated so as to have antibacterial and/or UV-resistant properties so as to (1) prevent bacterial growth around or on the edge strip, and (2) prevent the edge strip from breaking down under constant bombardment by sunlight. As shown in FIGS. 1, and 8–9, the edge strip 16 may be a single thickness of foam material. Alternatively, as shown in FIG. 7, the edge strip can comprise multiple layers, such as an inner layer 16*a* of material into which the first sheet and second sheet are embedded, and an outer layer 16*b* configured to press against the window opening 30. In such a configuration, the first inner layer 16*a* may comprise material having a higher density than the second outer layer. For example, the inner layer may be polyolefin having a density of 4–6 lb/cu. ft., and the outer layer may be polyurethane having a density of ½ to 2 lb/cu. ft.

At least one of the two transparent sheets 12, 14 includes deformations 18 having flat tops 20 extending out of the plane of the sheet on one side thereof. As shown in FIG. 9, the flat-topped deformations may be provided on just one of the sheets, with the other sheet being substantially planar. Alternatively, as shown in FIGS. 1–8, the flat-topped deformations may be provided in both sheets, and aligned with and extend toward each other. The insulative window covering of the present invention is not limited to only two transparent sheets. As shown in FIG. 7, the window covering may include a third sheet 13 of substantially transparent material, disposed between the first and second sheets. As shown, the first and second sheets are bonded atop their respective flat-topped deformations to the third sheet. This third sheet may be substantially planar, as shown in FIG. 7, or may be configured with deformations.

Still referring to FIG. 7, the third sheet 13 has a perimeter that is substantially coextensive with the perimeter of the first and second sheets 12, 14, so that it extends to the edge strip 16, thus dividing the space 22 between the sheets into at least two portions 22*a*, 22*b*. This can increase the insulative value of the window covering by providing two insulating layers of air in the window covering, instead of just one. Indeed, it will be apparent that any number of transparent sheets can be attached together to form an insulative window covering having any number of insulating air layers. The provision of multiple sheets can include both flat and deformed sheets. For example, rather than a middle sheet 13 that is flat (as in FIG. 7), a middle sheet that includes deformations on both sides thereof (not shown) could be adhesively bonded between two other flat sheets. Other variations are also possible.

The flat-topped deformations 18 may be configured in a variety of ways. In the embodiment of FIGS. 1–6, the deformations comprise a plurality of parallel rows and columns of opposingly oriented elongate ridges that are perpendicular to each other and are disposed at generally equally spaced-apart intervals across the opposed faces of the first and second sheets. Opposing ridges 18 are adhesively bonded together along their flat top edges 20, creating a plurality of discrete volumetric regions that have the appearance of separate window panes.

Figure 2:
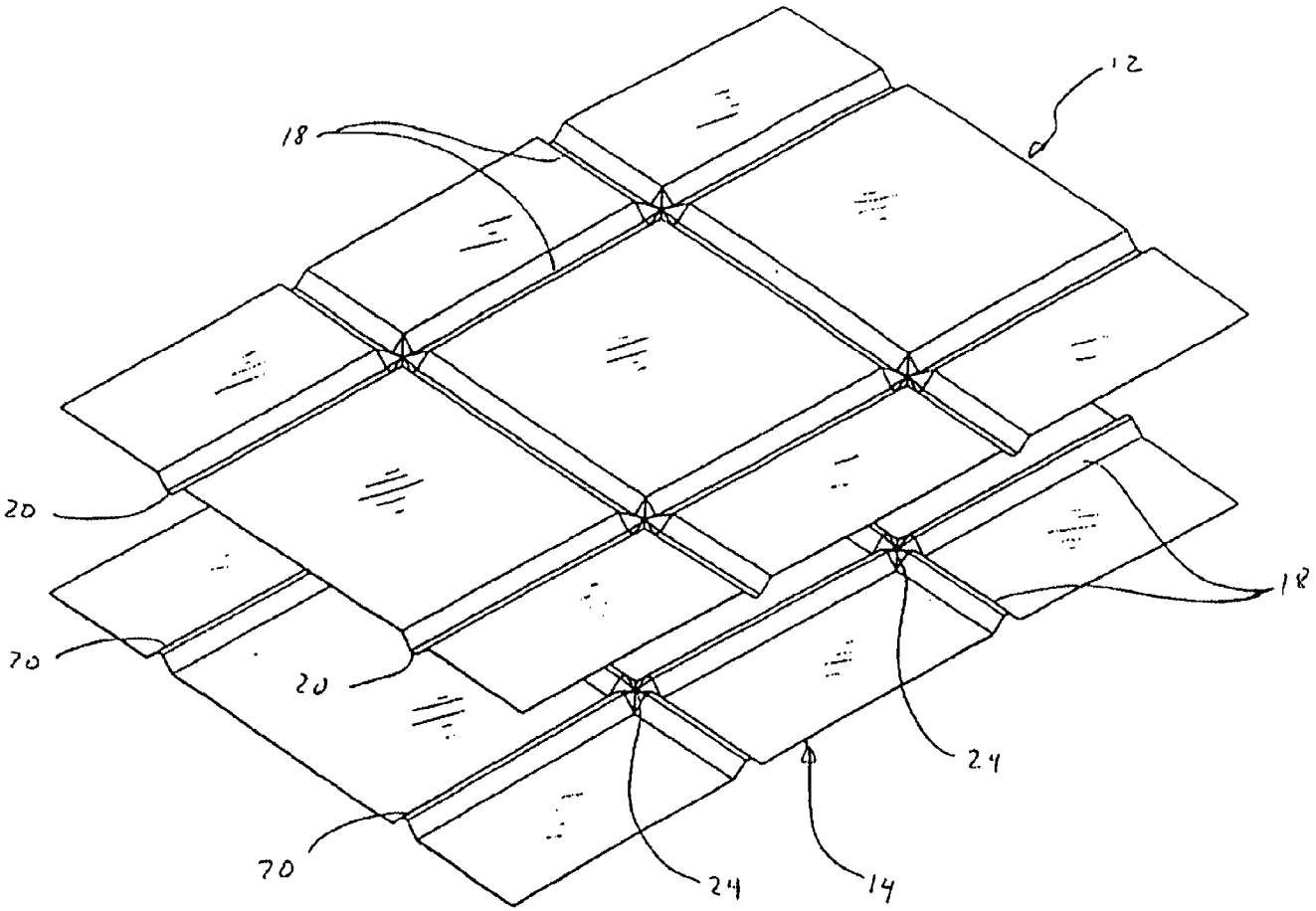
FIG. 2 is a perspective view of the top and bottom sheets of the window covering of FIG. 1.
Figure 3:
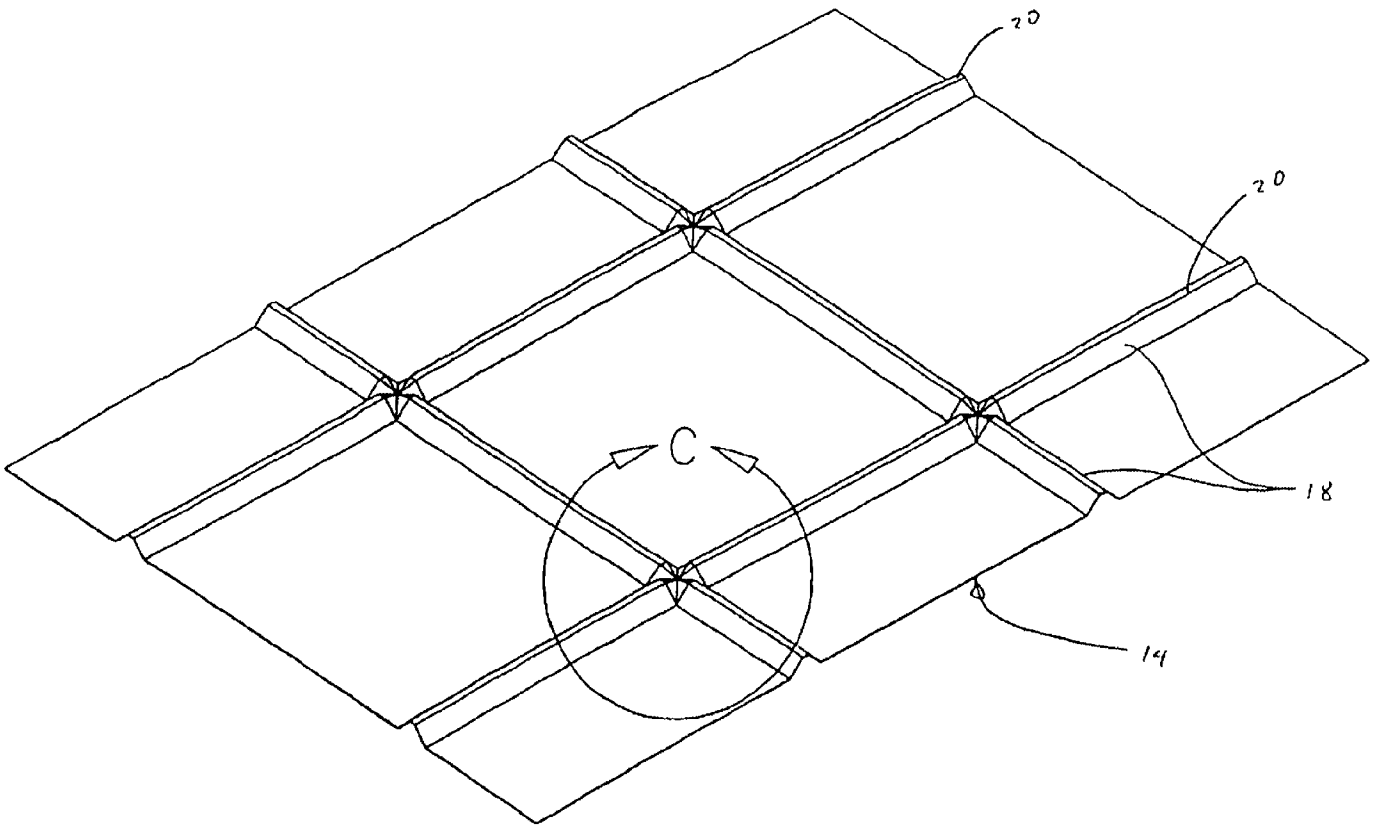
FIG. 3 is a perspective view of the bottom sheet of the window covering of FIG. 2.
Figure 6:
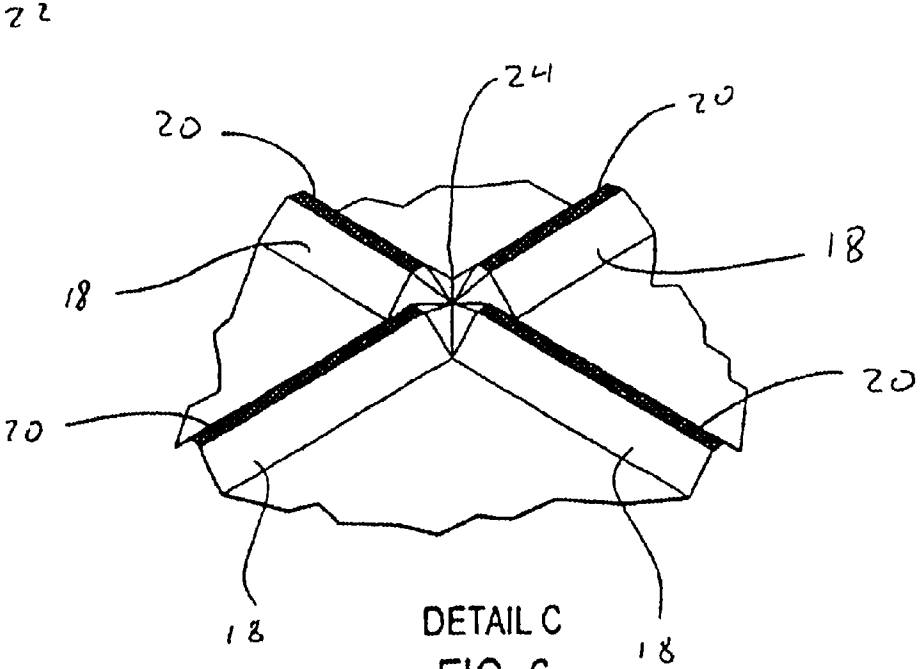
FIG. 6 is a detail view from FIG. 3 of the intersection of ridges in the bottom sheet showing the means of fluid communication between adjacent chambers in the window covering.
Figure 4:
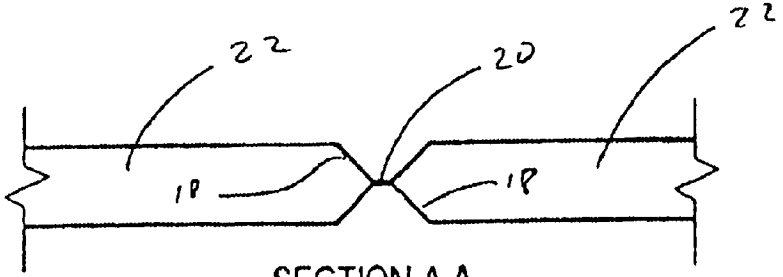
FIG. 4 is a cross-sectional view taken along lines A—A in FIG. 1.
Figure 5:
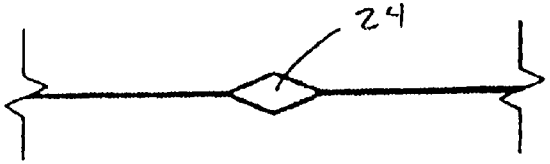
FIG. 5 is a cross-sectional view taken along lines B—B in FIG. 1.

While the discrete volumetric regions are configured as generally rectangular areas in the embodiment of FIGS. 1–3, it will be apparent that other geometric configurations are possible. For example, the ridges 18 could be arranged at angles, to give the appearance of diamond shaped window panes, or could be curved and/or intersect in various other ways to create a different appearance. Many other variations are also possible. For example, the deformations need not comprise elongate ridges. Instead, the deformations could be discrete (i.e. unconnected) protrusions of any shape, or a combination of elongate ridges and other shapes.

The deformations 18 serve several purposes. First, they increase the mechanical strength of the sheets 12, 14, allowing a much thinner sheet to be used for a given window size, and without a perimeter frame, as discussed above. This helps reduce the weight of the insulative window cover 10, while still allowing it to stand upright without buckling when pressed into the window opening. The inventors have found that transparent sheets of clear PET of approximately 0.03 inches thickness, with elongate ridges of ⅜" height and ¼" width disposed in a rectangular configuration (as in FIGS. 1–3) at a spacing of 12" are adequate for window coverings up to 8 feet in height.

The flat tops 20 of the deformations 18 also provide a flat contact surface for bonding the two sheets together. This bonding may be accomplished in several ways. A wide variety of adhesives may be used to bond the sheets together along the flat tops of the deformations, including solvent-based adhesives, UV-cured adhesives, etc. Naturally, the proper adhesive will largely depend upon the material used for the two sheets. Alternatively, a thermal bond (i.e. heat welding) or thermally-set adhesive may be used to bond the deformations together. The adhesive may be selected to provide a transparent bond between the adjacent transparent sheets, so as not to introduce visual distortion. Alternatively, an adhesive or adhesive-bearing material may be used that provides a visual indication of the deformation. For example, an opaque adhesive or strip of double-sided adhesive tape (such as white or black tape) may be used along the elongate ridges of FIGS. 1–3 to accentuate the appearance of discrete window panes.

The deformations 18 also divide the interior volume of space 22 between the sheets 12, 14 into discrete volumetric regions. The division of the interior volume of the window cover into discrete regions has the advantage of reducing the effect of convection currents between the transparent sheets. Where an insulating window or window covering includes large unobstructed areas, heating naturally produces convection currents within the gas volume. These have the effect of disturbing the boundary layer on the inside surfaces of the enclosure. The boundary layer is a very thin film of molecules clinging to these surfaces, and provides a large share of the total insulation value of insulating window structures. The provision of smaller areas reduces this effect because the temperature difference between the top and bottom of a smaller area is not great enough to initiate an exchange or movement of the enclosed gas.

The discrete volumetric regions may be in fluid communication with each other, or may be sealed and isolated from each other. Each of these alternatives presents its own set of benefits and drawbacks. In the embodiment of FIGS. 1–3, the intersections of perpendicular ridges 18 are formed so as to create gaps 24 between the two sheets (See also FIGS. 5, 6). These gaps allow fluid communication between the rectangular volumes in each "pane." This advantageously allows the entire interior envelope of the window covering to be filled with gas from a single inlet or source, making manufacture simpler. However, it will be apparent that where the separate volumetric regions are in fluid communication with each other, if a single leak develops, the gas in the entire envelope can escape. Alternatively, if the separate volumetric regions are sealed from each other, each must be filled separately, which makes manufacture more complicated, though a single leak will not allow all of the gas to escape.

One advantage of the present invention is that the overall size and shape of the temporary insulating window covering 10 may be readily and inexpensively modified during manufacture, or at the site of installation. In the manufacturing process, transparent sheets are first molded to the desired shape to provide the flat-topped deformations 18. Forming the deformations can be done by cold-stamping, roll-forming, hot-forming, or press-forming the initially flat sheets of transparent polymer material. The formed sheets may be fabricated in some large standard size and shape, such as 6'-0"×8'-0". Once formed, corresponding pairs of these sheets are then aligned and bonded together along the deformations, and along the edge tab 17, if there is one. The bonded pairs of sheets are then cut to the proper size and shape for a particular window opening. Advantageously, because the sheets are made of a relatively thin polymer material, they are relatively simple and easy to cut to any desired size and shape. Cutting can be accomplished by various means such as blades, routers, water jet, or laser cutting systems.

Next, the edge strip 16 is bonded to the outer periphery of the sheets to complete the structure. Because there are several different edge strip configurations, there are several different ways to attach the edge strip. For example, the edge strip can be shaped as a channel that is the same width on the inside as the window is thick, and attached by an adhesive between the over-lapping channel and the outside surfaces of the window. Another method would be to provide slots in the edge strip to match the contour of the window. This slot could then be coated or filled with a suitable adhesive and slopped over the window's edges. Suitable adhesives could include cyanoacrylates, anaerobic or epoxy.

When the edge strip is securely in place, creating an airtight enclosure envelope, the space 22 between the transparent sheets is then filled with the desired gas. This may be done by forcing gas from one side of the window to the other, thereby purging the ambient air from the envelope, or by submerging a window in a container of heavier-than-air gas, thereby displacing the ambient air. At this point, the insulating window is complete and ready to install.

Given the relative simplicity of construction, these window covers can be custom-constructed at the site of installation. For example, a worker can transport a supply of full size bonded pairs of transparent sheets, uncut edge strip material, and adhesive to an installation site. Based on window measurements taken at the work site, the worker can then cut the full size sheets to the specific size and shape needed, and bond the edge strip 16 to the sheets. Using a supply of pressurized inert gas, the worker then fills the airtight space 22 between the sheets with the desired gas, and the window cover is complete and ready to install. The tools, equipment, and supplies for making the complete window covers are thus simple and easy to transport, making custom installations simple and easy to complete at the site or at a factory.

The transparent sheets of the present invention can also be provided with coatings or additives to modify their performance in various ways. For example, one or more of the transparent sheets can be coated with a reflective coating to help reduce the intensity of light and heat that enters the building. The reflective coating could provide a bronze or silver exterior appearance, in the same manner as widely-used reflective glass. This makes the invention useful both for keeping heat in, and for keeping it out.

Other types of coatings or additives can also be applied to the transparent sheets for various other reasons. For example, a scratch-proof coating similar to that applied to plastic eyeglass lenses can be applied to the transparent sheets. Also, a UV inhibiting coating or additive can be used to reduce the amount of ultraviolet light that can pass through the window covering. Among other benefits, reduction of UV can help soften the light that passes through the window covering, and thereby reduce glare, and can reduce color fading of textiles and other materials. Other known coatings or additives could also be used for other reasons.

The invention thus provides an insulating window cover that is configured to be temporarily installed within a window opening inside a building, and utilizes a gas as the insulating medium. The invention is of a particularly simple and inexpensive construction. It provides two (or more) sheets of transparent material that are formed to have a shape that provides greater strength, are adhesively bonded in various locations, and do not require a perimeter frame.

It is to be understood that the above-referenced arrangements are illustrative of the application for the principles of the present invention. Numerous modifications and alternative arrangements can be devised without departing from the spirit and scope of the present invention while the present invention has been shown in the drawings and described above in connection with the exemplary embodiments(s) of the invention. It will be apparent to those of ordinary skill in the art that numerous modifications can be made without departing from the principles and concepts of the invention as set forth in the claims.

What is claimed is:

1. An insulative window covering, configured to be frictionally inserted into a window opening in a building, comprising:

a) a first sheet of substantially transparent material, having an inner and outer surface, a perimeter, and comprising at least one inwardly extending, flat-topped deformation;

b) an oppositely facing second sheet of substantially transparent material, having an inner and outer surface in parallel alignment with the first sheet, having a perimeter aligned with the perimeter of the first sheet, and comprising at least one flat-topped deformation extending inwardly toward and in alignment with the inwardly extending flat-topped deformation of the first sheet, the flat-topped deformations of the first and second sheets being bonded together; and c) a strip of resilient, compressible material, bonded around the periphery of the first sheet and the second sheet, configured to provide a substantially airtight enclosure envelope between the two sheets, and to provide a substantially airtight seal between the window opening and the window covering.

2. An insulative window covering in accordance with claim 1, wherein the at least one flat-topped deformation in the first sheet and in the second sheet comprise a plurality of opposingly oriented elongate ridges, configured to divide the enclosure envelope into a plurality of discrete volumetric regions, and to create the appearance of separate window panes.

3. An insulative window covering in accordance with claim 2, wherein the plurality of opposingly oriented ridges comprise a plurality of perpendicularly oriented rows and columns, configured to give the appearance of rectangular window panes.

4. An insulative window covering in accordance with claim 3, wherein the plurality of rows and columns are disposed at generally equally spaced-apart intervals across the opposed faces of the first and second sheets.

5. An insulative window covering in accordance with claim 2, further comprising intersections between ridges, and gaps between the two sheets at the intersections, so as to allow fluid communication between the discrete volumetric regions.

6. An insulative window covering in accordance with claim 1, further comprising an inert gas disposed in the enclosure envelope between the first and second sheets.

7. An insulative window covering in accordance with claim 6, wherein the inert gas is selected from the group consisting of nitrogen, helium, neon, argon, krypton, and xenon.

8. An insulative window covering in accordance with claim 1, further comprising a coating disposed on at least one of the first and second sheets, the coating being selected from the group consisting of a reflective coating, a scratch-proof coating, and a UV inhibitor.

9. An insulative window covering in accordance with claim 1, wherein the perimeter of the first sheet is bonded to the perimeter of the second sheet.

10. An insulative window covering in accordance with claim 9, wherein the first sheet and the second sheet are bonded along a folded-down tab disposed along the perimeter of each sheet.

11. An insulative window covering in accordance with claim 1, wherein the perimeter of the first sheet and the perimeter of the second sheet are embedded into the strip of resilient, compressible material.

12. An insulative window covering in accordance with claim 11, wherein the strip of resilient, compressible material comprises an inner layer into which the first sheet and second sheet are embedded, and an outer layer configured to press against the window opening, the first layer having a higher density than the second layer.

13. An insulative window covering in accordance with claim 1, wherein the strip of resilient, compressible material is selected from the group consisting of antibacterial polymer foams, and UV-resistant polymer foams.

14. An insulative window covering in accordance with claim 1, wherein the sheets of substantially transparent material are selected from the group consisting of PET, PETG, and PVC.

15. An insulative window covering in accordance with claim 14, wherein the sheets of substantially transparent material are about 0.03 inches in thickness.

16. An insulative window covering in accordance with claim 14, wherein the sheets of substantially transparent material having flat-topped ridges are formed using a process selected from the group consisting of cold stamping, roll forming, hot forming, and press forming.

17. An insulative window covering in accordance with claim 1, further comprising a third sheet of substantially transparent material, disposed between the first and second sheets, having a perimeter that is substantially coextensive with the perimeter of the first and second sheets, the first and second sheets being bonded to the third sheet.

18. An insulative window covering in accordance with claim 1, wherein the first and second sheets are bonded together using a method selected from the group consisting of adhesives and thermal bonding.

* * * * *